US011279993B2

(12) United States Patent
Furuya et al.

(10) Patent No.: US 11,279,993 B2
(45) Date of Patent: Mar. 22, 2022

(54) NICKEL-CONTAINING STEEL PLATE

(71) Applicant: NIPPON STEEL CORPORATION, Tokyo (JP)

(72) Inventors: Hitoshi Furuya, Tokyo (JP); Kentaro Watanabe, Tokyo (JP); Keisuke Mori, Tokyo (JP); Masakazu Asaba, Tokyo (JP); Yoshiaki Suematsu, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 52 days.

(21) Appl. No.: 16/650,283

(22) PCT Filed: Dec. 27, 2018

(86) PCT No.: PCT/JP2018/048244
§ 371 (c)(1),
(2) Date: Mar. 24, 2020

(87) PCT Pub. No.: WO2020/136829
PCT Pub. Date: Jul. 2, 2020

(65) Prior Publication Data

US 2021/0222277 A1 Jul. 22, 2021

(51) Int. Cl.
*C22C 38/08* (2006.01)
*C22C 38/54* (2006.01)
(Continued)

(52) U.S. Cl.
CPC ..... *C22C 38/54* (2013.01); *C21D 8/0205* (2013.01); *C21D 8/0226* (2013.01); *C21D 9/46* (2013.01);
(Continued)

(58) Field of Classification Search
None
See application file for complete search history.

(56) References Cited

U.S. PATENT DOCUMENTS

2015/0147222 A1* 5/2015 Miura ..... C22C 38/005 420/83

FOREIGN PATENT DOCUMENTS

JP 8-27517 A 1/1996
JP 2002-161341 A 6/2002
(Continued)

OTHER PUBLICATIONS

"Metallic materials—Tensile testing—Method of test at room temperature", JIS Z 2241, 2011, total 169 pages.
(Continued)

*Primary Examiner* — Seth Dumbris
*Assistant Examiner* — Kim S. Horger
(74) *Attorney, Agent, or Firm* — Birch, Stewart, Kolasch & Birch, LLP

(57) ABSTRACT

A nickel-containing steel plate according to an aspect of the present invention has a chemical composition within a predetermined range, in which an average coarse grain size of prior austenite which is defined as a simple average value of maximum values of equivalent circle diameters of prior austenite grains in each of ten visual fields having an area of 200 $\mu m^2$, measured at a ¼t position of the steel plate in a section formed by a rolling direction of the steel plate and a thickness direction of the steel plate is 20 μm or less, and a tensile strength is 690 MPa to 900 MPa.

6 Claims, 1 Drawing Sheet

(51) Int. Cl.

| | |
|---|---|
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.
CPC ..... *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C21D 2211/001* (2013.01)

(56) References Cited

FOREIGN PATENT DOCUMENTS

| | | | |
|---|---|---|---|
| JP | 2003-160811 | A | 6/2003 |
| JP | 2005-226080 | A | 8/2005 |
| JP | 2008-75107 | A | 4/2008 |
| JP | 2008-81776 | A | 4/2008 |
| JP | 2011-21243 | A | 2/2011 |
| JP | 5381440 | B2 | 1/2014 |
| WO | WO 2015/064045 | A | 5/2015 |

OTHER PUBLICATIONS

"Method of Charpy pendulum impact test of metallic materials", JIS Z 2242, 2018, total 70 pages.
"Nickel steel plates for pressure vessels for low temperature services", JIS G 3127, 2013, total 46 pages.
International Search Report for PCT/JP2018/048244 dated Mar. 26, 2019.

* cited by examiner

NICKEL-CONTAINING STEEL PLATE

TECHNICAL FIELD OF THE INVENTION

The present invention relates to a nickel-containing steel plate.

RELATED ART

With the strengthening of environmental regulations, LNG-fueled ships that sail by driving the engine by LNG instead of heavy oil have been developed. It is considered that in addition to austenitic stainless steel, ferritic steel for low temperature service such as 9% Ni steel can be used as a material for the LNG tank mounted on the LNG-fueled ship. However, in the ferritic nickel steel for low temperature service, a decrease in toughness due to strain aging is shown, and overcoming this is the key to commercialization. For example, it is desirable that the lowest value of the Charpy impact absorbed energy at −196° C. of a material subjected to a heat treatment at 200° C. for one hour after applying a strain of 6% is 150 J or more. This is not necessarily easy to achieve at the current state of the art. It is possible to slightly improve the low temperature toughness by performing an intermediate heat treatment (so-called L treatment), but this is not sufficient, and this leads to an increase in manufacturing costs.

A low value occurring with a very low probability in the Charpy impact absorbed energy at −196° C. of the ferritic nickel steel for low temperature service may be associated with inclusions. In a steel slab manufactured by continuous casting, inclusions of several μm remain without floating and separating. However, when cleanliness is normal, the influence of such independent inclusions on the Charpy impact absorbed energy at −196° C. is small. However, in a case where clusters of inclusions of several μm aggregated and coalesced are formed, the Charpy impact absorbed energy at −196° C. of the material subjected to the heat treatment at 200° C. for one hour after applying a strain of 6% may decrease to 150 J or less.

As a method for reducing harmful effects of inclusions, for example, stretched inclusions such as MnS, there is cross rolling. Cross rolling is, in hot rolling for creating the shape of a steel plate, a part of the rolling performed in the width direction of the steel plate partway through the rolling usually performed only in the longitudinal direction of the steel plate. In a case where the inclusions are MnS, stretching of MnS in the longitudinal direction of the steel plate is suppressed, and in a Charpy test using a test piece of which the longitudinal direction of the test piece is parallel to the rolling width direction, the Charpy impact absorbed energy is improved.

For example, in Patent Document 1, bending workability and low temperature toughness are improved by performing width-direction rolling in a non-recrystallization temperature range when cross rolling is performed. However, the width-direction rolling in the non-recrystallization temperature range needs to be performed at an initial stage of rolling due to restrictions on the width-direction length, and this increases a rolling waiting time and significantly reduces a rolling efficiency (productivity). Moreover, the width-direction rolling starts in the non-recrystallization temperature range while a rolling reduction in a recrystallization temperature range is insufficient, so that the rolling in the non-recrystallization temperature range is performed while austenite grain sizes are large, and there are cases where the toughness is still unstable. Therefore, this method cannot achieve the above-described object. Moreover, in Patent Document 2, there is provided a steel plate which has high isotropy by specifying the rolling reduction ratio between width-direction rolling and longitudinal-direction rolling at the time of performing cross rolling. Although this method is effective for the control of inclusions, there are cases where refinement of austenite grains during the rolling is not necessarily sufficient only by specifying the rolling reduction ratio, and this method cannot achieve the above-described object.

That is, with the current technology, it is difficult to provide a nickel-containing steel plate having excellent toughness with high production efficiency.

PRIOR ART DOCUMENT

[Patent Document]

[Patent Document 1] Japanese Unexamined Patent Application, First Publication No. 2005-226080

[Patent Document 2] Japanese Unexamined Patent Application, First Publication No. 2002-161341

DISCLOSURE OF THE INVENTION

Problems to be Solved by the Invention

An object of the present invention is to provide a nickel-containing steel plate having excellent toughness.

Means for Solving the Problem

This invention provides the nickel-containing steel plate excellent in toughness, and the gist thereof is as follows.

(1) According to an aspect of the present invention, a nickel-containing steel plate includes, as a chemical composition, by mass %: C: 0.02% to 0.12%; Si: 0.02% to 0.35%; Mn: 0.10% to 1.50%; P: 0.0100% or less; S: 0.0035% or less; Ni: more than 5.0% and 10.0% or less; Al: 0.002% to 0.090%; N: 0.0070% or less; O: 0.0030% or less; Cu: 0% to 2.00%; Cr: 0% to 5.00%; Mo: 0% to 1.00%; B: 0% to 0.0050%; Nb: 0% to 0.050%; Ti: 0% to 0.050%; V: 0% to 0.050%; Ca: 0% to 0.0300%; Mg: 0% to 0.0300%; REM: 0% to 0.0300%; and a remainder: Fe and impurities, in which an average coarse grain size of prior austenite which is defined as a simple average value of maximum values of equivalent circle diameters of prior austenite grains in each of ten visual fields having an area of 200 $\mu m^2$, measured at a ¼t position of the steel plate in a section formed by a rolling direction of the steel plate and a thickness direction of the steel plate, is 20 μm or less, and a tensile strength is 690 MPa to 900 MPa.

(2) In the nickel-containing steel plate according to (1), an average aspect ratio of the prior austenite grains defined as a simple average value of ratios between major axes and minor axes of the prior austenite grains in the visual fields of 200 $\mu m^2$ in the section at the ¼t position may be 1.5 or less.

(3) In the nickel-containing steel plate according to (1) or (2), an amount of residual austenite at the ¼t position may be 0.1% or more and less than 5% by volume %.

(4) In the nickel-containing steel plate according to (1) or (2), an amount of residual austenite at the ¼t position may be 5% to 15% by volume %.

Effects of the Invention

According to the present invention, it is possible to provide a nickel-containing steel plate having excellent toughness. Therefore, it can be said that the present invention is an industrially valuable invention.

EMBODIMENTS OF THE INVENTION

Figure 1:
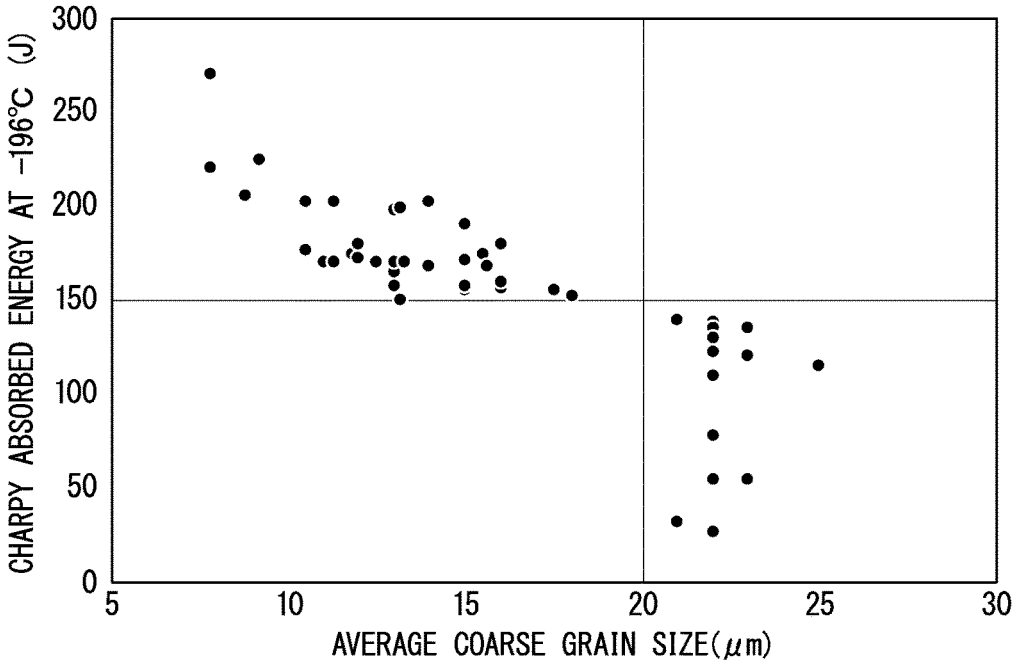
FIG. 1 is a graph showing the relationship between the average coarse grain size of prior austenite of a nickel-containing steel plate and the low temperature toughness of the nickel-containing steel plate.

A nickel-containing steel plate according to the present embodiment (hereinafter, sometimes referred to as a steel plate according to the present embodiment, or a steel plate) will be described in detail. The inventors intensively examined whether or not a decrease in toughness in a steel plate having a Ni content of more than 5.0% and 10.0% or less among nickel-containing steel plates for low temperature service can be avoided or recovered in a step after hot rolling other than a steelmaking step. As a result, it was found that the toughness of the steel plate can be effectively improved by refining the average coarse grain size of prior austenite at a ¼t position of the steel plate, and the average coarse grain size of the prior austenite at the ¼t position of the steel plate is significantly refined by slightly increasing a temperature rising rate between 600° C. or higher and 750° C. or lower during temperature rising for reheating quenching after appropriate hot rolling and direct quenching. Refinement of the average coarse grain size of the prior austenite leads to refinement of the final microstructure, that is, a microstructure primarily containing tempered martensite and bainite, and thus can significantly improve the toughness of the steel plate. The average coarse grain size of the prior austenite is a simple average value of the maximum values of equivalent circle diameters of prior austenite grains in each of ten visual fields having an area of 200 $\mu m^2$, which are measured in a section formed by the rolling direction of the steel plate and the thickness direction of the steel plate at the ¼t position of the steel plate. A specific measurement method of the average coarse grain size of the prior austenite will be described later. Hereinafter, unless otherwise specified, "the average coarse grain size of the prior austenite at the ¼t position of the steel plate" is simply referred to as "the average coarse grain size of the prior austenite".

In the steel plate according to the present embodiment, in order to greatly refine the average coarse grain size of the prior austenite, for example, it is effective to combine two manufacturing methods. The first point is to appropriately control conditions of hot rolling performed before hardening and direct quenching. The second point is to appropriately control temperature rising conditions during reheating quenching after rolling.

Specifically, a manufacturing method of a steel plate according to the present embodiment includes a hot rolling and direct quenching step (A step), a reheating quenching step (B step), and a tempering step (C step). First, conditions of an initial A step, that is, hot rolling performed before hardening and direct quenching will be described.

In the hot rolling and direct quenching step (A step), a cast piece or steel piece containing Ni in more than 5.0% and 10.0% or less is heated, then hot-rolled, and thereafter water-cooled. The hot rolling may be performed with a total rolling reduction of 75% or more (that is, the total rolling reduction ratio defined by slab thickness/steel plate thickness is 4 or more), and the temperature before one finishing pass may be set to 600° C. or higher and 850° C. or lower. Here, the total rolling reduction in the hot rolling is a value obtained by dividing the difference between the thickness of the steel piece before the start of the hot rolling and the thickness of the steel plate after the finish of the hot rolling by the thickness of the steel piece before the start of the hot rolling. The temperature before one finishing pass is the temperature of the surface of the steel plate measured immediately before one final pass of the hot rolling (specifically, within 5 seconds from the time when one final pass is performed).

In a case where the temperature before one finishing pass is 850° C. or lower, the microstructure when cooled to room temperature by water cooling becomes fine, so that the average coarse grain size of the prior austenite becomes small. In addition, when the temperature before one finishing pass is set to 600° C. or higher, deformation resistance is reduced, whereby hot rolling with a total rolling reduction of 75% or more can be easily performed. Furthermore, when the total rolling reduction of the hot rolling is set to 75% or more, the microstructure after the water cooling is refined, so that the average coarse grain size of the prior austenite becomes small.

Temperature Rising Rate during Reheating quenching;

Next, the B step, that is, the reheating quenching step will be described. By setting the temperature rising rate during heating during the reheating quenching, that is, the average temperature rising rate in a temperature range of 600° C. or higher and 750° C. or lower to 0.4° C./sec or more and 0.8° C./sec or less, the average coarse grain size of the prior austenite can be greatly refined. In a case where the average temperature rising rate in the temperature range of 600° C. or higher and 750° C. or lower during the reheating quenching is 0.4° C./sec or more, the average coarse grain size of the prior austenite becomes small. On the other hand, when the average temperature rising rate in the temperature range of 600° C. or higher and 750° C. or lower is set to 0.8° C./sec or less, control of the heating temperature during the reheating quenching is facilitated. As will be described later, the heating temperature during the reheating quenching may be controlled within a very narrow range of, for example, 800° C. or higher and 810° C. or lower. Setting the average temperature rising rate in the temperature range of 600° C. or higher and 750° C. or lower to 0.8° C./sec or less contributes to achievement of precise control of the heating temperature during the reheating quenching (such as prevention of overheating, that is, overshooting). The average temperature rising rate in the temperature range of 600° C. or higher and 750° C. or lower is a value obtained by dividing 150° C. (=750° C.-600° C.) by the time required to raise the temperature of the steel plate from 600° C. to 750° C.

In order to clarify the temperature interval in which the temperature rising rate has to be increased, the present inventors compared the average coarse grain size of prior austenite when standard temperature rising (condition 1) was performed at an average temperature rising rate of 0.1° C./sec between 200° C. or higher and a hardening heating temperature or lower to the average coarse grain size of prior austenite under three conditions under which the average temperature rising rate was increased to 0.6° C./sec only in a specific temperature range and the average temperature rising rate in the other temperature ranges was set to 0.1°

C./sec, that is, condition 2 under which the average temperature rising rate only between 200° C. or higher and lower than 600° C. was set to 0.6° C./sec, condition 3 under which the average temperature rising rate only between 600° C. or higher and 750° C. or lower was set to 0.6° C./sec, and condition 4 under which the average temperature rising rate only between higher than 750° C. and the hardening heating temperature or lower was set to 0.6° C./sec. As a result, as shown in Table 1, under the condition under which the average temperature rising rate only between 600° C. or higher and 750° C. or lower was set to 0.6° C./sec and the average temperature rising rate in the other temperature ranges was set to 0.1° C./sec, significant refinement of the average coarse grain size of the prior austenite was observed. For this reason, in a case where the average coarse grain size of the prior austenite is to be refined by increasing the temperature rising rate, it is effective to increase the average temperature rising rate between 600° C. or higher and 750° C. or lower.

TABLE 1

| Condition | Average temperature rising rate between 200° C. or higher and lower than 600° C. (° C./s) | Average temperature rising rate between 600° C. or higher and 750° C. or lower (° C./s) | Average temperature rising rate between higher than 750° C. and hardening heating temperature or lower (° C./s) | Prior austenite grain size (μm) |
|---|---|---|---|---|
| 1 | 0.1 | 0.1 | 0.1 | 28 |
| 2 | 0.6 | 0.1 | 0.1 | 22 |
| 3 | 0.1 | 0.6 | 0.1 | 16 |
| 4 | 0.1 | 0.1 | 0.6 | 25 |

As is clear from the above definition, the average coarse grain size of prior austenite is a parameter that focuses on coarse grains in the grain size distribution of prior austenite. The present inventors found that even in a case where the prior austenite is refined, in a case where coarse grains remain, the toughness is reduced at the remaining points. Therefore, in the steel plate according to the present embodiment, the average coarse grain size of prior austenite is 20 μm or less, that is, no coarse grains remain. When the average coarse grain size of the prior austenite is refined, the final microstructure is also refined. The average coarse grain size of the prior austenite at the ¼t position, which is necessary to achieve 150 J as an absorbed energy of a Charpy test at a test temperature of −196° C., needs to be 20 μm or less. The average coarse grain size of the prior austenite at the ¼t position is preferably 18 μm or less, 16 μm or less, 15 μm or less, or 14 μm or less. The lower limit of the average coarse grain size of the prior austenite at the ¼t position is not particularly limited, but this may be specified to be, for example, 5 μm or more, 7 μm or more, or 8 μm or more.

A measurement method of the average coarse grain size of the prior austenite at the ¼t position is as follows. A section formed by the rolling direction of the steel plate and the thickness direction of the steel plate of a sample taken from the ¼t position (position distant from the rolled surface of the steel plate by ¼ of the plate thickness t of the steel plate) is polished, and prior austenite grain boundaries in this section are revealed using picric acid. Thereafter, in a random visual field having an area of 200 $\mu m^2$ in this section, the largest prior austenite grain is specified and the equivalent circle diameter thereof is calculated. This operation is repeated in ten random visual fields, and the simple average value of the ten equivalent circle diameters obtained is regarded as the average coarse grain size of the prior austenite at the ¼t position.

The rolling direction of the steel plate is generally the longitudinal direction of the steel plate. However, in a case where the rolling direction of the steel plate is unknown, the rolling direction of the steel plate can be perceived by a known method such as a method in which a steel plate is immersed in an acid (for example, hydrochloric acid) at a high temperature (for example, 80° C. or higher) and a microstructure stretched by rolling is observed.

The steel plate according to the present embodiment subjected to the reheating quenching after the hot rolling and direct quenching has almost no stretched prior austenite grains at the ¼t position. Therefore, the average aspect ratio of the prior austenite, which is a simple average value of the ratio between the major axis to the minor axis (minor axis/major axis) of the austenite grains at the ¼t position becomes smaller than that of the steel plate by the direct quenching, which has not been subjected to the reheating quenching treatment. Normally, the average aspect ratio of the prior austenite does not exceed 2.0. In many cases, the average aspect ratio is 1.5 or less. As necessary, the average aspect ratio may be set to 1.4 or less, 1.3 or less, or 1.2 or less. The lower limit of the average aspect ratio is 1.0.

A measurement method of the average aspect ratio of the prior austenite at the ¼t position is as follows. A section formed by the rolling direction and the plate thickness direction of a sample taken from the ¼t position (position distant from the rolled surface of the steel plate by ¼ of the plate thickness t of the steel plate) is polished, and prior austenite grain boundaries in this section are revealed using picric acid. Thereafter, in a random visual field of 200 $\mu m^2$ in this section, the ratio between the major axis and the minor axis (minor axis/major axis) of each prior austenite grain is measured, and a simple average value of the ratios is regarded as the average aspect ratio of the prior austenite at the ¼t position.

Next, the ranges of alloying elements included in the chemical composition of the steel plate are defined below. Hereinafter, unless otherwise specified, the unit "%" in the amounts of the alloying element means mass %.

C is an essential element for securing the strength of the steel plate. In addition, in a case where the C content is insufficient, there are cases where a decrease in strength and a decrease in toughness are caused. Therefore, the C content is set to 0.02% or more. However, on the other hand, an increase in the amount of C causes a decrease in toughness. Therefore, the upper limit of the amount of C is set to 0.12%. The amount of C may be set to 0.03% or more, 0.05% or more, or 0.07% or more. The amount of C may be set to 0.11% or less, 0.10% or less, or 0.08% or less.

Si is an essential element for securing the strength of the steel plate, so that the amount thereof is set to 0.02% or more. However, on the other hand, more than 0.35% of Si causes a decrease in the toughness and weldability of the steel plate. Therefore, the upper limit of the amount of Si is set to 0.35%. The amount of Si may be set to 0.03% or more, 0.05% or more, or 0.09% or more. The amount of Si may be set to 0.30% or less, 0.25% or less, 0.20% or less, 0.15% or less, or 0.10% or less.

Mn is an element effective for increasing the strength of the steel plate, and needs to be contained in at least 0.10% or more. On the other hand, when Mn is contained in more than 1.50%, a temper embrittlement parameter becomes high and the toughness of the steel plate decreases. Therefore, the Mn content is specified to be 0.10% or more and 1.50% or less. The amount of Mn may beset to 0.30% or more, 0.40% or more, 0.50% or more, or 0.60% or more. The amount of Mn may be set to 1.20% or less, 1.00% or less, 0.90% or less, or 0.80% or less.

P is an element unnecessary for the steel plate according to the present embodiment, and thus there is no need to particularly specify the lower limit of the amount thereof. The lower limit of the P content may be 0%. However, when the amount of P is less than 0.0010%, there are cases where productivity decreases significantly due to an increase in a refining load, and the lower limit thereof may be set to 0.0010%. On the other hand, when the amount of P exceeds 0.0100%, the toughness of the steel plate decreases due to temper embrittlement. Therefore, the P content is set to 0.0100% or less. The amount of P may be set to 0.0090% or less, 0.0080% or less, or 0.0060% or less.

S is an element unnecessary for the steel plate according to the present embodiment, and thus there is no need to particularly specify the lower limit of the amount thereof. The lower limit of the S content may be set to 0%. However, when the amount of S is less than 0.0001%, there are cases where the productivity decreases significantly due to an increase in the refining load, and the lower limit thereof may be set to 0.0001%. On the other hand, when the amount of S exceeds 0.0035%, the toughness of the steel plate decreases. Therefore, the S content is set to 0.0035% or less. The amount of S may beset to 0.0005% or more, 0.0010% or more, or 0.0015% or more. The amount of S may be set to 0.0030% or less, 0.0025% or less, or 0.0020% or less.

Ni needs to be contained in at least more than 5.0% in order to secure the toughness and strength of the steel plate. On the other hand, when the amount of Ni exceeds 10.0%, the manufacturing costs of the steel plate increase significantly. Therefore, the Ni content is set to more than 5.0% and 10.0% or less. The amount of Ni may beset to 5.5% or more, 6.0% or more, or 7.0% or more. The amount of Ni may be set to 9.5% or less, 9.0% or less, or 8.0% or less.

In the present embodiment, the nickel-containing steel plate means a steel plate having a Ni content of more than 5.0% and 10.0% or less.

Al is an element effective for deoxidation of the steel plate, and needs to be contained in at least 0.002% or more. On the other hand, when Al is contained in more than 0.090%, the toughness of the steel plate decreases. Therefore, the Al content is set to 0.002% to 0.090%. The amount of Al may be set to 0.005% or more, 0.010% or more, or 0.020% or more. The amount of Al may be set to 0.080% or less, 0.070% or less, or 0.060% or less.

N can be intentionally added but is an element that is incorporated as an impurity even in a case where N is not intentionally added. There is no need to particularly specify the lower limit of the amount of N, and the lower limit thereof may be set to 0%. However, in a case where the amount of Nis set to less than 0.0001%, the productivity decreases significantly due to an increase in the refining load. Therefore, the amount of N may be set to 0.0001% or more. On the other hand, in a case where the amount of the N exceeds 0.0070%, the toughness of the steel plate decreases. Therefore, the upper limit of the amount of N is set to 0.0070%. The amount of N may be set to 0.0002% or more, 0.0005% or more, or 0.0010% or more. The amount of N may be set to 0.0060% or less, 0.0050% or less, or 0.0040% or less.

O is the total amount of oxygen in the composition of the steel plate. O is an element unnecessary for the steel plate according to the present embodiment, so that the lower limit of O need not be particularly specified in terms of material properties, and the lower limit thereof may be set to 0%. However, in a case where the amount of O is set to less than 0.0001%, the productivity decreases significantly due to an increase in the refining load. Therefore, the amount of O may be set to 0.0001% or more. On the other hand, in a case where the amount of O exceeds 0.0030%, the toughness of the steel plate decreases. Therefore, the upper limit of the O amount is 0.0030%. The amount of O may be set to 0.0005% or more, 0.0010% or more, or 0.0015% or more. The amount of O may be set to 0.0025% or less, 0.0020% or less, or 0.0018% or less.

In addition, the steel plate according to the present embodiment may optionally further contain the following elements. However, the steel plate according to the present embodiment can solve the problem without using the following elements. Therefore, the lower limit of the elements listed below is 0%.

Cu has an effect of improving the strength of the steel plate. In order to obtain this effect, the amount of Cu is preferably set to 0.01% or more. On the other hand, when the amount of Cu exceeds 2.00%, there is concern that the toughness of the steel plate may decrease. Therefore, the Cu content is set to 0% to 2.00%. The amount of Cu may be set to 0.10% or more, 0.15% or more, or 0.20% or more. The amount of Cu may be set to 1.50% or less, 1.00% or less, 0.70% or less, 0.50%, or 0.30% or less.

Cr is an element that improves the hardenability of the steel plate and affects the strength of the steel plate. In order to obtain the effect of improving strength by Cr, the amount of Cr is preferably set to 0.01% or more. On the other hand, in a case where the amount of Cr exceeds 5.00%, there is concern that the toughness and weldability of the steel plate may decrease. Therefore, the Cr content is set to 0% to 5.00%. The amount of Cr may beset to 0.10% or more, 0.20% or more, or 0.25% or more. The amount of Cr may be set to 3.00% or less, 2.00% or less, 1.00% or less, 0.80% or less, 0.60% or less, or 0.50% or less.

Mo is an element effective for securing the strength of the steel plate and reducing temper embrittlement. In order to obtain these effects of Mo, the amount of Mo is preferably set to 0.01% or more. On the other hand, in a case where the amount of Mo exceeds 1.00%, there is concern that the toughness and weldability of the steel plate may decrease. Therefore, the Mo content is set to 0% to 1.00%. The amount of Mo may be set to 0.05% or more, 0.08% or more, 0.15% or more, or 0.20% or more. The amount of Mo may be set to 0.80% or less, 0.70% or less, 0.50%, 0.40% or less, 0.30% or less, or 0.25% or less.

B is an element effective for improving the hardenability of the steel plate and affecting the strength of the steel plate. In order to obtain these effects of B, the amount of B is preferably set to 0.0002% or more. On the other hand, in a case where the B content exceeds 0.0050%, there is concern that the toughness of the steel plate may decrease. Therefore, the B content is set to 0% to 0.0050% or less. The amount of B content may be set to 0.0002% or more, 0.0004% or more, or 0.0005% or more. The amount of B may be set to 0.0030% or less, 0.0020% or less, or 0.0015% or less.

Nb is an element effective for securing the strength of the steel plate. In order to obtain this effect of Nb, the amount of Nb is preferably set to 0.001% or more. On the other hand, in a case where the amount of Nb exceeds 0.050%, there is concern that a decrease in the toughness of the steel plate may be caused. Therefore, the Nb content is set to 0% to 0.050%. The amount of Nb may be set to 0.005% or more, 0.010% or more, or 0.015% or more. The amount of Nb may be set to 0.040% or less, 0.030% or less, or 0.025% or less.

Ti is an element effective for securing the strength of the steel plate. In order to obtain this effect of Ti, the amount of Ti is preferably set to 0.001% or more. On the other hand, in a case where the amount of Ti exceeds 0.050%, there is concern that a decrease in the toughness of the steel plate may be caused. Therefore, the Ti content is set to 0% to 0.050%. The amount of T may be set to 0.005% or more, 0.010% or more, or 0.020% or more. The amount of M may be set to 0.040% or less, 0.030% or less, or 0.025% or less.

V is an element effective for securing the strength of the steel plate. In order to obtain this effect of V, the amount of V is preferably set to 0.001% or more. On the other hand, in a case where the amount of V exceeds 0.050%, there is concern that a decrease in the toughness may be caused. Therefore, the V content is set to 0% to 0.050%. The amount of V may be set to 0.002% or more, 0.005% or more, or 0.010% or more. The amount of V may be set to 0.040% or less, 0.030% or less, or 0.020% or less.

Ca is an element that affects the grain size of the steel plate and affects the strength of the steel plate. Furthermore, Ca is an element effective for preventing nozzle clogging during casting of a slab that is a raw material for a steel plate. In order to obtain these effects of Ca, the amount of Ca is preferably set to 0.0003% or more. On the other hand, in a case where the amount of Ca exceeds 0.0300%, there is concern that a decrease in the toughness of the steel plate may be caused. Therefore, the Ca content is preferably set to 0% to 0.0300%. The amount of Ca may be set to 0.0010% or more, 0.0020% or more, or 0.0030% or more. The amount of Ca may be set to 0.0100% or less, 0.0080% or less, or 0.0050% or less.

Mg is an element that affects the strength of the steel plate and is effective in improving the toughness of the steel plate. In order to obtain these effects of Mg, the amount of Mg is preferably set to 0.0003% or more. On the other hand, in a case where the amount of Mg exceeds 0.0300%, there is concern that a decrease in the toughness may be caused. Therefore, the Mg content is set to 0% to 0.0300%. The amount of Mg may be set to 0.0005% or more, 0.0010% or more, or 0.0020% or more. The amount of Mg may be set to 0.0100% or less, 0.0080% or less, or 0.0050% or less.

The term "REM" refers to a total of 17 elements composed of rare earth elements, that is, Sc, Y, and lanthanoids, and the "REM content" means the total amount of these 17 elements. REM is an element that affects the strength of the steel plate and is effective in improving the toughness of the steel plate. In order to obtain these effects of REM, the amount of REM is preferably set to 0.0003% or more. On the other hand, in a case where the amount of REM exceeds 0.0300%, there is concern that a decrease in the toughness of the steel plate may be caused. Therefore, the REM content is set to 0% to 0.0300%. The amount of REM may be set to 0.0005% or more, 0.0010% or more, or 0.0020% or more. The amount of REM may be set to 0.0100% or less, 0.0080% or less, or 0.0050% or less.

The remainder of the chemical composition of the steel plate according to the present embodiment consists of iron and impurities. Impurities are, for example, eluted from raw materials used, which contain additive alloys, or from furnace materials during melting when steel plates and welding materials are manufactured. Such impurities are also allowed within a range that does not impair the characteristics of the steel plate according to the present embodiment. For example, Zn, Sn, Sb, and the like, which can be incorporated as impurities, are allowed in an amount of each of the elements incorporated of less than 0.01% because the effect of the steel plate according to the present embodiment is not impaired.

The tensile strength of the steel plate according to the present embodiment is in a range of 690 MPa or more and 900 MPa or less. This is substantially the same as, for example, the tensile strength of steel plates specified in JIS G 3127:2013 as nickel steel plates for pressure vessels for low temperature services, and is a tensile strength range obtained for general welded structures such as shipbuilding, bridges, architecture, offshore structures, pressure vessels, tanks, and line pipes.

In addition, it is preferable that the yield point or proof stress of the steel plate according to the present embodiment is set to 520 MPa or more or 590 MPa or more. The upper limit thereof need not be particularly determined, and may be set to 690 MPa or less.

The plate thickness of the steel plate according to the present embodiment is not particularly limited. For example, the thickness of the steel plate according to the present embodiment may be set to 6 mm to 100 mm, which is a thickness range of steel plates used in general welded structures as described above. As necessary, the lower limit thereof may be set to 10 mm or 12 mm, and the upper limit thereof may be set to 80 mm, 60 mm, or 50 mm.

The metallographic structure of the steel plate according to the present embodiment is not particularly limited. For example, in the metallographic structure at the ¼t position of the steel plate according to the present embodiment obtained by a manufacturing method in which an intermediate heat treatment (so-called L treatment) is not performed, the amount of residual austenite is 0.1% or more and less than 5% by volume % in many cases. The amount of residual austenite in the metallographic structure at the ¼t position of the steel plate according to the present embodiment obtained by the manufacturing method in which an intermediate heat treatment is not performed may be specified to be 0.2% or more, 0.3% or more, or 0.5% or more by volume %. The amount of residual austenite in the metallographic structure at the ¼t position of the steel plate according to the present embodiment obtained by the manufacturing method in which an intermediate heat treatment is not performed may be specified to be 4.8% or less, 4.5% or less, 4.2% or less, or 4% or less by volume %.

On the other hand, in the metallographic structure at the ¼t position of the steel plate according to the present embodiment obtained by a manufacturing method in which an intermediate heat treatment is performed, the amount of residual austenite is 5% to 15% by volume % in many cases. The amount of residual austenite in the metallographic structure at the ¼t position of the steel plate according to the present embodiment obtained by the manufacturing method in which an intermediate heat treatment is performed may be specified to be 6% or more, 7% or more, 8% or more, or 9% or more by volume %. The amount of residual austenite in the metallographic structure at the ¼t position of the steel plate according to the present embodiment obtained by the manufacturing method in which an intermediate heat treatment is performed may be specified to be 14% or less, 13% or less, 12% or less, or 10% or less by volume %.

In any case, the remainder of the metallographic structure at the ¼t position of the steel plate becomes a microstructure primarily containing tempered martensite. The higher the amount of residual austenite, the higher the low temperature toughness. However, even if the amount of residual austenite at the ¼t position of the steel plate is less than 5% by volume % by omitting the intermediate heat treatment, the average coarse grain size of the prior austenite of the steel plate according to the present embodiment is preferably controlled, so that excellent low temperature toughness can be secured. In consideration of manufacturing costs, it is preferable to set the amount of residual austenite at the ¼t position of the steel plate to 0% to less than 5% by volume % by omitting the intermediate heat treatment.

Measurement of the volume fraction (volume %) of the residual austenite of the steel plate is performed according to the following procedure. A test piece is taken from the ¼t position of the steel plate, and the surface of the test piece is processed to be the ¼t position of the steel plate by grinding and polishing. Thereafter, the diffraction intensities of the (200) and (211) planes of $\alpha$ and the (200), (220), and (311) planes of $\gamma$ are obtained by X-ray diffraction, and the volume fraction of the residual austenite is obtained based on the diffraction intensities.

Next, a preferable example of the manufacturing method in which the steel plate according to the present embodiment can be reliably manufactured will be described.

The steel plate is manufactured by a method of performing hot rolling on a slab manufactured by continuous casting by the above method. However, in addition to the above description, for example, the following conditions performed in order to generally refine a microstructure primarily containing martensite and bainite may be applied.

- Steel piece heating temperature before hot rolling: 1050° C. to 1250° C.
- Total rolling reduction in hot rolling: 75% or more as mentioned above
- Controlled rolling (CR) start temperature: 850° C. or lower
- Total rolling reduction (CR ratio) in controlled rolling: 60% or more
- Temperature before one finishing pass: 600° C. to 850° C. as described above
- Water cooling start temperature after hot rolling: 580° C. or higher
- Average water cooling rate: 3.0° C./sec or more
- Water cooling finishing temperature: 150° C. or lower Here, controlled rolling is rolling that introduces strain into a steel plate by rolling at a high rolling reduction at a relatively low temperature. In the manufacturing method of the steel plate according to the present embodiment, for convenience, rolling performed at 850° C. or lower is defined as controlled rolling. Therefore, in the present embodiment, "total rolling reduction in controlled rolling" has the same meaning as "cumulative rolling reduction at 850° C. or lower". The temperature at which the controlled rolling (CR) is performed is preferably lower. For this reason, it is more preferable to perform the controlled rolling after a decrease in the temperature of the slab by air-cooling the slab after the finish of rolling at higher than 850° C. (by temporarily suspending rolling). The temperature at the start of the controlled rolling in this case (however, the temperature is 850° C. or lower from the definition) is called a controlled rolling start temperature (CR start temperature).

The total rolling reduction in the controlled rolling is a value obtained by dividing the difference between the thickness of the slab before the start of the controlled rolling and the thickness of the steel plate after the finish of the controlled rolling by the thickness of the slab before the start of the controlled rolling.

The water cooling start temperature after hot rolling is the temperature of the surface of the steel plate when a cooling medium such as cooling water starts to be sprayed onto the hot-rolled steel plate after the finish of the hot rolling.

The water cooling finishing temperature is the temperature of the surface of the steel plate when the spraying of the cooling medium onto the hot-rolled steel plate is finished.

The average water cooling rate is a value obtained by dividing the difference between the water cooling start temperature and the water cooling finishing temperature by the cooling medium spraying time.

In the hot rolling and direct quenching step (A step), in a case where the heating temperature of the slab is 1250° C. or lower, grain growth of austenite is suppressed, thereby refining the microstructure primarily containing martensite after transformation. In a case where the heating temperature of the slab is 1050° C. or higher, rolling resistance in the hot rolling can be reduced. Therefore, the heating temperature of the slab before the hot rolling is set to 1050° C. or higher and 1250° C. or lower.

As described above, the hot rolling is performed at a total rolling reduction of 75% or more, and the temperature before one finishing pass is set to 600° C. or higher and 850° C. or lower. In addition, the total rolling reduction in a pass in which rolling is performed at 850° C. or lower among the total hot rolling passes, that is, the total rolling reduction in the controlled rolling is separately set to 60% or more. By performing rolling at a high rolling reduction at a temperature as low as 850° C. or lower, fine austenite grains can be obtained during heating during subsequent reheating quenching.

In the water cooling after the hot rolling (direct quenching), the water cooling start temperature is set to 580° C. or higher. By starting water cooling at a temperature as high as 580° C. or higher, a fine hardened microstructure can be obtained. Moreover, the average cooling rate during the water cooling is set to 3.0° C./sec or more. Accordingly, a fine hardened microstructure can be obtained. In addition, although it is not necessary to provide the upper limit of the water cooling rate from a viewpoint of the characteristics of a steel plate, installation costs can be kept low by causing the average cooling rate during the water cooling to be 100° C./sec or less. Therefore, the average cooling rate during the water cooling is preferably set to 100° C./sec or less. In order to perform direct quenching, a water cooling stop temperature is set to 150° C. or lower.

After the hot rolling and direct quenching step, that is, after the A step, the B step which is the reheating quenching step is performed. As described above, the average temperature rising rate between 600° C. or higher and 750° C. or lower during the reheating quenching is set to 0.4° C./sec or more and 0.8° C./sec or less. In addition, in a case where the heating temperature during the reheating quenching is 800° C. or higher, an untransformed microstructure can be prevented from remaining and the toughness of the steel plate can be increased. In a case where the heating temperature during the reheating quenching is 810° C. or lower, the toughness can be improved by refining the prior austenite during the reheating quenching heating. Therefore, the heating temperature during the reheating quenching is set to 800° C. or higher and 810° C. or lower. In addition, the heating temperature during the reheating quenching heating is the retention temperature of the steel plate at the time of the reheating quenching. The retention time during the reheating quenching heating, which will be described later, means a time during which the temperature of the steel plate is in a range of 800° C. to 810° C.

In a case where the retention time during the reheating quenching heating is 5 minutes or longer, the material of the steel plate is uniformized. In a case where the retention time during the reheating quenching heating is 100 minutes or shorter, the microstructure can be refined and the toughness can be improved. Therefore, the retention time during the reheating quenching heating may be set to, for example, 5 minutes or longer and 100 minutes or shorter.

In the hardening step described above, it is considered necessary to perform a heat treatment using a heat treatment furnace. In a normal shallow heating hardening step, there are cases where hardening is performed using a high-frequency heating apparatus or the like capable of rapidly raising the temperature for the purpose of improving manufacturing efficiency. However, according to such a heating apparatus, it is difficult to control the temperature of the steel plate within an extremely narrow temperature range of 600° C. to 610° C. described above. In particular, it is difficult to retain the temperature of the steel plate for 5 minutes or longer within this temperature range. Therefore, it is desirable to perform furnace heating that facilitates controlling of the hardening temperature of the steel plate within a narrow range. The same applies to other heat treatments in the manufacturing method of the steel plate according to the present embodiment.

As necessary, an intermediate heat treatment can be performed between the reheating quenching and tempering. In a case where the heating temperature of the intermediate heat treatment is 660° C. or higher, the toughness of the steel plate can be improved. In a case where the heating temperature of the intermediate heat treatment is 700° C. or lower, the effect of improving toughness by stabilizing the prior austenite during heating for the intermediate heat treatment can be secured. From the above description, the heating temperature of the intermediate heat treatment is set to 660° C. or higher and 700° C. or lower. However, in the manufacturing method of the steel plate according to the present embodiment, good low temperature toughness can be imparted to the steel plate without performing an intermediate heat treatment.

In a case where the retention time of the intermediate heat treatment is 5 minutes or longer, reverse transformation progresses, and the prior austenite is stabilized during hardening heating, so that an effect of improving the toughness can be obtained. In a case where the retention time of the intermediate heat treatment is 30 minutes or shorter, the prior austenite at the time of heating of the reheating quenching is stabilized, and the toughness of the steel plate can be increased. From the above description, the retention time of the intermediate heat treatment is set to 5 minutes or longer and 30 minutes or shorter. The heating temperature of the intermediate heat treatment is the retention temperature of the hot-rolled steel plate during the intermediate heat treatment. The retention time of the intermediate heat treatment means a time during which the steel plate temperature is in a range of 660° C. to 700° C.

In a case where the tempering temperature in the C step which is the tempering step is 570° C. or higher, it is possible to prevent a decrease in toughness due to temper embrittlement. In a case where the tempering temperature is 590° C. or lower, the toughness of the steel plate can be increased. From the above description, the tempering may be preferably performed at 570° C. or higher and 590° C. or lower. Moreover, in a case where the retention time of the tempering is 5 minutes or longer, the toughness can be improved. In a case where the retention time of the tempering is 30 minutes or shorter, the productivity can be improved. From the above description, the retention time of the tempering may be set to 5 minutes or longer and 30 minutes or shorter. The heating temperature of the tempering is the retention temperature of the hot-rolled steel plate during the tempering. The retention time of the tempering means a time during which the temperature of the steel plate is in a range of 570° C. to 590° C.

EXAMPLES

A tensile test and a Charpy impact test were conducted on steel plates having a plate thickness of 18 mm or 43 mm manufactured under various chemical compositions and manufacturing conditions. The chemical compositions of the steel plates, hot rolling and direct quenching conditions, plate thickness, heat treatment conditions, the average coarse grain size of prior austenite, the amount of residual austenite (amount of residual γ), the average aspect ratio of prior austenite (average aspect ratio), and evaluation results of mechanical properties are shown in Tables 2-1 to 5-2. The retention time in the intermediate heat treatment was set to 20 minutes for a plate thickness of 18 mm and 40 minutes for a plate thickness of 43 mm. All heat treatments were performed using a heat treatment furnace. The chemical composition of the steel plate and the average coarse grain size of prior austenite outside the ranges of the invention were underlined. In addition, mechanical property values that did not satisfy the acceptance criteria were also underlined. In addition, although the amount of residual austenite was described in the tables, the remainder of the metallographic structure of all the examples and the comparative examples was substantially entirely tempered martensite. The average coarse grain size of prior austenite, the amount of residual austenite, and the average aspect ratio of prior austenite were measured according to the methods described above.

The tensile test was conducted based on the tensile test method of metallic materials described in JIS Z 2241:2011. In a case of a steel plate thickness of more than 20 mm, a No. 4 test piece was used, and the test piece was taken at a portion inward from the surface of the steel plate by ¼ of the plate thickness so that the longitudinal direction of the test piece was perpendicular to the rolling direction. In a case of a steel plate thickness of 20 mm or less, a JIS No. 5 test piece was used, and the test piece was taken so that the longitudinal direction thereof was perpendicular to the rolling direction. Two tests were conducted at room temperature, and an average tensile strength of 690 MPa or more and 900 MPa or less was accepted.

In the Charpy impact test, a V-notch test piece of JIS Z 2242:2018 was taken from a steel plate which was subjected to a strain of 6% in advance at room temperature and thereafter subjected to a heat treatment at 200° C. for one hour, at a portion inward from the surface of the steel plate by ¼ of the plate thickness so that the longitudinal direction of the test piece was perpendicular to the rolling direction and a notch leading edge connecting line was parallel to the plate thickness direction. A pre-strain direction was an L direction (the rolling direction of the steel plate). Three tests were conducted at a test temperature of −196° C., and an average value of three values of 150 J or more was regarded as being acceptable.

TABLE 2-1

| | C | Si | Mn | P | S | Ni | Al | N | O | Others |
|---|---|---|---|---|---|---|---|---|---|---|
| | mass %, remainder consists of iron and impurities | | | | | | | | | |
| Example 1 | 0.09 | 0.27 | 1.19 | 0.0023 | 0.0022 | 5.7 | 0.013 | 0.0019 | 0.0015 | |
| Comparative Example 1 | 0.13 | 0.28 | 1.24 | 0.0024 | 0.0022 | 5.9 | 0.013 | 0.0020 | 0.0015 | |
| Example 2 | 0.11 | 0.31 | 0.45 | 0.0063 | 0.0020 | 5.5 | 0.045 | 0.0031 | 0.0022 | |
| Comparative Example 2 | 0.01 | 0.31 | 0.45 | 0.0064 | 0.0020 | 5.5 | 0.045 | 0.0031 | 0.0023 | |
| Example 3 | 0.07 | 0.23 | 0.92 | 0.0040 | 0.0017 | 6.1 | 0.012 | 0.0042 | 0.0017 | |
| Comparative Example 3 | 0.07 | 0.36 | 0.93 | 0.0041 | 0.0018 | 6.3 | 0.012 | 0.0044 | 0.0018 | |
| Example 4 | 0.04 | 0.20 | 0.30 | 0.0047 | 0.0021 | 5.5 | 0.011 | 0.0012 | 0.0022 | |
| Comparative Example 4 | 0.02 | 0.01 | 0.30 | 0.0045 | 0.0021 | 5.5 | 0.012 | 0.0012 | 0.0022 | |
| Example 5 | 0.10 | 0.23 | 0.89 | 0.0026 | 0.0012 | 6.1 | 0.041 | 0.0013 | 0.0018 | 0.30Cr, 0.10Mo |
| Comparative Example 5 | 0.10 | 0.23 | 1.61 | 0.0026 | 0.0013 | 6.4 | 0.041 | 0.0013 | 0.0018 | 0.30Cr, 0.10Mo |
| Example 6 | 0.05 | 0.06 | 0.32 | 0.0039 | 0.0023 | 7.2 | 0.018 | 0.0022 | 0.0026 | |
| Comparative Example 6 | 0.05 | 0.07 | 0.04 | 0.0039 | 0.0024 | 7.5 | 0.019 | 0.0023 | 0.0026 | |
| Example 7 | 0.07 | 0.06 | 0.47 | 0.0077 | 0.0019 | 5.9 | 0.029 | 0.0025 | 0.0020 | |
| Comparative Example 7 | 0.08 | 0.06 | 0.49 | 0.0110 | 0.0020 | 6.2 | 0.031 | 0.0025 | 0.0021 | |
| Example 8 | 0.06 | 0.25 | 0.75 | 0.0027 | 0.0006 | 6.8 | 0.035 | 0.0034 | 0.0011 | |
| Comparative Example 8 | 0.07 | 0.26 | 0.76 | 0.0028 | 0.0038 | 6.8 | 0.036 | 0.0034 | 0.0011 | |
| Example 9 | 0.09 | 0.13 | 0.91 | 0.0081 | 0.0014 | 8.4 | 0.035 | 0.0041 | 0.0017 | |
| Comparative Example 9 | 0.09 | 0.14 | 0.92 | 0.0083 | 0.0014 | 4.2 | 0.036 | 0.0041 | 0.0017 | |
| Example 10 | 0.10 | 0.14 | 0.62 | 0.0045 | 0.0010 | 7.7 | 0.017 | 0.0030 | 0.0017 | 0.50Cr, 0.04Mo |
| Comparative Example 10 | 0.10 | 0.15 | 0.65 | 0.0047 | 0.0010 | 7.7 | 0.120 | 0.0030 | 0.0017 | 0.50Cr, 0.04Mo |
| Example 11 | 0.07 | 0.04 | 0.50 | 0.0084 | 0.0013 | 8.1 | 0.022 | 0.0035 | 0.0022 | |
| Comparative Example 11 | 0.07 | 0.04 | 0.51 | 0.0087 | 0.0013 | 8.4 | 0.023 | 0.0078 | 0.0023 | |
| Example 12 | 0.06 | 0.06 | 1.03 | 0.0043 | 0.0023 | 9.2 | 0.042 | 0.0045 | 0.0014 | |
| Comparative Example 12 | 0.06 | 0.06 | 1.06 | 0.0045 | 0.0024 | 9.2 | 0.042 | 0.0047 | 0.0033 | |
| Example 13 | 0.06 | 0.30 | 0.98 | 0.0043 | 0.0017 | 7.3 | 0.041 | 0.0042 | 0.0024 | 0.25Cr, 0.09Mo |
| Comparative Example 13 | 0.06 | 0.30 | 1.01 | 0.0044 | 0.0017 | 7.5 | 0.042 | 0.0043 | 0.0024 | 0.25Cr, 0.09Mo |
| Example 14 | 0.09 | 0.17 | 1.02 | 0.0061 | 0.0020 | 5.9 | 0.036 | 0.0015 | 0.0019 | 0.20Cu |
| Comparative Example 14 | 0.09 | 0.17 | 1.07 | 0.0062 | 0.0021 | 6.2 | 0.036 | 0.0015 | 0.0020 | 0.20Cu |
| Example 15 | 0.08 | 0.07 | 0.33 | 0.0039 | 0.0024 | 6.6 | 0.009 | 0.0012 | 0.0019 | 0.50Cr, 0.010Nb |
| Comparative Example 15 | 0.08 | 0.07 | 0.33 | 0.0041 | 0.0025 | 6.6 | 0.009 | 0.0012 | 0.0020 | 0.50Cr, 0.010Nb |
| Example 16 | 0.04 | 0.19 | 0.85 | 0.0056 | 0.0007 | 6.1 | 0.040 | 0.0025 | 0.0024 | 0.020V |
| Comparative Example 16 | 0.04 | 0.19 | 0.88 | 0.0058 | 0.0007 | 6.4 | 0.041 | 0.0026 | 0.0025 | 0.020V |

TABLE 2-2

| | C | Si | Mn | P | S | Ni | Al | N | O | Others |
|---|---|---|---|---|---|---|---|---|---|---|
| | mass %, remainder consists of iron and impurities | | | | | | | | | |
| Example 17 | 0.04 | 0.14 | 0.58 | 0.0083 | 0.0009 | 7.6 | 0.018 | 0.0039 | 0.0011 | 0.30Cr, 0.012Ti |
| Comparative Example 17 | 0.04 | 0.14 | 0.61 | 0.0084 | 0.0009 | 7.7 | 0.018 | 0.0040 | 0.0012 | 0.30Cr, 0.012Ti |
| Example 18 | 0.03 | 0.17 | 0.54 | 0.0068 | 0.0023 | 9.1 | 0.035 | 0.0043 | 0.0011 | 0.0015Ca |
| Comparative Example 18 | 0.03 | 0.17 | 0.56 | 0.0069 | 0.0023 | 9.3 | 0.035 | 0.0044 | 0.0011 | 0.0015Ca |
| Example 19 | 0.06 | 0.11 | 0.66 | 0.0024 | 0.0010 | 6.3 | 0.013 | 0.0040 | 0.0018 | 0.08Cr, 0.05Mo, 0.0018Mg |
| Comparative Example 19 | 0.06 | 0.12 | 0.68 | 0.0024 | 0.0010 | 6.5 | 0.014 | 0.0042 | 0.0019 | 0.07Cr, 0.05Mo, 0.0018Mg |
| Example 20 | 0.05 | 0.06 | 0.60 | 0.0025 | 0.0008 | 9.0 | 0.036 | 0.0023 | 0.0009 | |
| Comparative Example 20 | 0.05 | 0.08 | 0.60 | 0.0120 | 0.0009 | 9.4 | 0.037 | 0.0022 | 0.0008 | |
| Example 21 | 0.07 | 0.15 | 0.53 | 0.0044 | 0.0011 | 6.4 | 0.009 | 0.0030 | 0.0010 | 0.65Cr |
| Comparative Example 21 | 0.07 | 0.16 | 0.54 | 0.0044 | 0.0012 | 6.6 | 0.010 | 0.0031 | 0.0010 | 0.66Cr |
| Example 22 | 0.08 | 0.18 | 1.14 | 0.0061 | 0.0005 | 9.0 | 0.036 | 0.0023 | 0.0023 | 0.0007B |
| Comparative Example 22 | 0.09 | 0.18 | 1.17 | 0.0063 | 0.0006 | 9.2 | 0.037 | 0.0024 | 0.0023 | 0.0007B |

TABLE 2-2-continued

| | C | Si | Mn | P | S | Ni | Al | N | O | Others |
|---|---|---|---|---|---|---|---|---|---|---|
| | mass %, remainder consists of iron and impurities | | | | | | | | | |
| Example 23 | 0.08 | 0.23 | 0.80 | 0.0045 | 0.0022 | 9.5 | 0.039 | 0.0024 | 0.0025 | 0.20Cr, 0.12Mo |
| Comparative Example 23 | 0.09 | 0.24 | 0.83 | 0.0046 | 0.0023 | 9.8 | 0.041 | 0.0024 | 0.0026 | 0.20Cr, 0.12Mo |
| Example 24 | 0.07 | 0.30 | 0.92 | 0.0075 | 0.0009 | 6.3 | 0.016 | 0.0016 | 0.0021 | |
| Comparative Example 24 | 0.07 | 0.30 | 0.94 | 0.0078 | 0.0010 | 6.6 | 0.017 | 0.0017 | 0.0021 | |
| Example 25 | 0.05 | 0.27 | 1.03 | 0.0049 | 0.0013 | 9.6 | 0.028 | 0.0043 | 0.0025 | 0.80Cr |
| Comparative Example 25 | 0.05 | 0.27 | 1.08 | 0.0051 | 0.0014 | 9.8 | 0.028 | 0.0044 | 0.0026 | 0.79Cr |
| Example 26 | 0.03 | 0.30 | 0.71 | 0.0061 | 0.0023 | 9.6 | 0.009 | 0.0011 | 0.0014 | |
| Comparative Example 26 | 0.03 | 0.31 | 0.72 | 0.0110 | 0.0038 | 9.7 | 0.009 | 0.0012 | 0.0015 | |
| Example 27 | 0.06 | 0.03 | 0.38 | 0.0055 | 0.0019 | 8.4 | 0.033 | 0.0026 | 0.0014 | 0.24Mo |
| Comparative Example 27 | 0.06 | 0.03 | 0.39 | 0.0055 | 0.0045 | 8.8 | 0.034 | 0.0026 | 0.0015 | 0.24Mo |
| Example 28 | 0.09 | 0.19 | 0.64 | 0.0067 | 0.0020 | 9.4 | 0.006 | 0.0013 | 0.0023 | |
| Comparative Example 28 | 0.09 | 0.19 | 0.64 | 0.0068 | 0.0021 | 9.9 | 0.006 | 0.0014 | 0.0033 | |
| Example 29 | 0.07 | 0.06 | 0.49 | 0.0075 | 0.0015 | 9.0 | 0.043 | 0.0021 | 0.0019 | 0.23Cr, 0.08Mo |
| Comparative Example 29 | 0.07 | 0.07 | 0.50 | 0.0075 | 0.0016 | 9.3 | 0.045 | 0.0075 | 0.0019 | 0.23Cr, 0.08Mo |
| Example 30 | 0.10 | 0.08 | 0.75 | 0.0067 | 0.0021 | 9.3 | 0.026 | 0.0025 | 0.0024 | 0.0021REM |
| Comparative Example 30 | 0.10 | 0.08 | 0.78 | 0.0069 | 0.0022 | 4.6 | 0.027 | 0.0026 | 0.0024 | 0.0021REM |
| Example 31 | 0.05 | 0.06 | 1.01 | 0.0040 | 0.0021 | 9.0 | 0.040 | 0.0040 | 0.0010 | |
| Comparative Example 31 | 0.05 | 0.06 | 1.05 | 0.0046 | 0.0023 | 9.0 | 0.041 | 0.0043 | 0.0010 | |
| Example 32 | 0.06 | 0.06 | 1.01 | 0.0045 | 0.0023 | 8.9 | 0.043 | 0.0046 | 0.0015 | |
| Comparative Example 32 | 0.06 | 0.06 | 1.02 | 0.0043 | 0.0025 | 8.9 | 0.041 | 0.0046 | 0.0015 | |
| Example 33 | 0.06 | 0.05 | 0.95 | 0.0041 | 0.0018 | 9.3 | 0.040 | 0.0045 | 0.0011 | |
| Comparative Example 33 | 0.07 | 0.05 | 0.96 | 0.0041 | 0.0017 | 9.1 | 0.041 | 0.0046 | 0.0011 | |

TABLE 3-1

| | Hot rolling | | | | | | | | |
|---|---|---|---|---|---|---|---|---|---|
| | Slab heating temperature ° C. | Total rolling reduction in hot rolling % | CR ratio % | CR start temperature ° C. | Temperature before one finishing pass ° C. | Water cooling start temperature ° C. | Average water cooling rate ° C./s | Water cooling finishing temperature ° C. | Plate thickness mm |
| Example 1 | 1100 | 93 | 67 | 835 | 765 | 797 | 50 | 20 | 18 |
| Comparative Example 1 | 1100 | 93 | 67 | 802 | 732 | 798 | 50 | 20 | 18 |
| Example 2 | 1100 | 93 | 67 | 802 | 732 | 837 | 50 | 20 | 18 |
| Comparative Example 2 | 1100 | 93 | 67 | 820 | 750 | 837 | 50 | 20 | 18 |
| Example 3 | 1200 | 90 | 67 | 810 | 740 | 757 | 50 | 100 | 18 |
| Comparative Example 3 | 1200 | 90 | 67 | 841 | 771 | 759 | 50 | 100 | 18 |
| Example 4 | 1050 | 90 | 67 | 802 | 732 | 758 | 50 | 20 | 18 |
| Comparative Example 4 | 1000 | 90 | 67 | 844 | 774 | 756 | 50 | 20 | 18 |
| Example 5 | 1100 | 93 | 67 | 801 | 731 | 759 | 50 | 20 | 18 |
| Comparative Example 5 | 1100 | 93 | 67 | 848 | 778 | 758 | 50 | 20 | 18 |
| Example 6 | 1100 | 93 | 67 | 830 | 760 | 797 | 50 | 20 | 18 |
| Comparative Example 6 | 1100 | 93 | 67 | 826 | 756 | 800 | 50 | 20 | 18 |
| Example 7 | 1200 | 90 | 67 | 849 | 779 | 800 | 50 | 20 | 18 |
| Comparative Example 7 | 1200 | 90 | 67 | 822 | 752 | 796 | 50 | 20 | 18 |
| Example 8 | 1050 | 90 | 67 | 834 | 764 | 808 | 50 | 20 | 18 |
| Comparative Example 8 | 1050 | 90 | 67 | 837 | 767 | 809 | 50 | 20 | 18 |
| Example 9 | 1100 | 93 | 67 | 809 | 739 | 757 | 50 | 20 | 18 |
| Comparative Example 9 | 1100 | 93 | 67 | 808 | 738 | 759 | 50 | 20 | 18 |
| Example 10 | 1100 | 93 | 67 | 847 | 777 | 759 | 50 | 20 | 18 |
| Comparative Example 10 | 1100 | 93 | 67 | 824 | 754 | 759 | 50 | 20 | 18 |

TABLE 3-1-continued

| | Hot rolling | | | | | | | | |
|---|---|---|---|---|---|---|---|---|---|
| | Slab heating temperature ° C. | Total rolling reduction in hot rolling % | CR ratio % | CR start temperature ° C. | Temperature before one finishing pass ° C. | Water cooling start temperature ° C. | Average water cooling rate ° C./s | Water cooling finishing temperature ° C. | Plate thickness mm |
| Example 11 | 1200 | 90 | 67 | 832 | 762 | 808 | 50 | 20 | 18 |
| Comparative Example 11 | 1200 | 90 | 67 | 814 | 744 | 809 | 50 | 20 | 18 |
| Example 12 | 1050 | 90 | 67 | 817 | 747 | 719 | 50 | 20 | 18 |
| Comparative Example 12 | 1050 | 90 | 67 | 841 | 771 | 718 | 50 | 20 | 18 |
| Example 13 | 1100 | 93 | 67 | 801 | 731 | 718 | 50 | 20 | 18 |
| Comparative Example 13 | 1330 | 93 | 67 | 840 | 770 | 718 | 50 | 20 | 18 |
| Example 14 | 1100 | 93 | 67 | 842 | 772 | 808 | 50 | 20 | 18 |
| Comparative Example 14 | 1100 | 93 | 67 | 865 | 820 | 889 | 50 | 20 | 18 |
| Example 15 | 1200 | 90 | 67 | 834 | 764 | 798 | 50 | 20 | 18 |
| Comparative Example 15 | 1200 | 90 | 67 | 920 | 870 | 827 | 50 | 20 | 18 |
| Example 16 | 1060 | 83 | 60 | 848 | 808 | 818 | 10 | 20 | 43 |
| Comparative Example 16 | 1060 | 67 | 60 | 845 | 805 | 819 | 10 | 20 | 43 |

TABLE 3-2

| | Hot rolling | | | | | | | | |
|---|---|---|---|---|---|---|---|---|---|
| | Slab heating temperature ° C. | Total rolling reduction in hot rolling % | CR ratio % | CR start temperature ° C. | Temperature before one finishing pass ° C. | Water cooling start temperature ° C. | Average water cooling rate ° C./s | Water cooling finishing temperature ° C. | Plate thickness mm |
| Example 17 | 1100 | 86 | 60 | 825 | 785 | 740 | 10 | 20 | 43 |
| Comparative Example 17 | 1100 | 86 | 60 | 846 | 806 | 740 | 10 | 20 | 43 |
| Example 18 | 1100 | 83 | 60 | 820 | 780 | 778 | 10 | 20 | 43 |
| Comparative Example 18 | 1100 | 83 | 60 | 821 | 781 | 779 | 10 | 20 | 43 |
| Example 19 | 1100 | 86 | 60 | 813 | 773 | 780 | 10 | 20 | 43 |
| Comparative Example 19 | 1100 | 86 | 60 | 842 | 802 | 779 | 10 | 20 | 43 |
| Example 20 | 1100 | 83 | 60 | 813 | 773 | 680 | 10 | 20 | 43 |
| Comparative Example 20 | 1100 | 83 | 60 | 804 | 764 | 679 | 10 | 20 | 43 |
| Example 21 | 1200 | 86 | 60 | 845 | 805 | 738 | 10 | 20 | 43 |
| Comparative Example 21 | 1200 | 86 | 60 | 840 | 800 | 739 | 10 | 20 | 43 |
| Example 22 | 1060 | 75 | 60 | 834 | 794 | 629 | 10 | 20 | 43 |
| Comparative Example 22 | 1060 | 75 | 60 | 846 | 806 | 630 | 10 | 20 | 43 |
| Example 23 | 1100 | 86 | 60 | 808 | 768 | 778 | 10 | 20 | 43 |
| Comparative Example 23 | 1100 | 86 | 60 | 843 | 925 | 904 | 10 | 20 | 43 |
| Example 24 | 1100 | 83 | 60 | 848 | 808 | 680 | 10 | 20 | 43 |
| Comparative Example 24 | 1100 | 83 | 60 | 827 | 787 | 680 | 10 | 20 | 43 |
| Example 25 | 1200 | 86 | 60 | 810 | 770 | 820 | 10 | 20 | 43 |
| Comparative Example 25 | 1200 | 50 | 60 | 805 | 765 | 819 | 10 | 20 | 43 |
| Example 26 | 1060 | 83 | 60 | 809 | 769 | 780 | 10 | 20 | 43 |
| Comparative Example 26 | 1060 | 83 | 60 | 804 | 764 | 779 | 10 | 20 | 43 |
| Example 27 | 1100 | 86 | 60 | 844 | 804 | 819 | 10 | 20 | 43 |
| Comparative Example 27 | 1100 | 86 | 60 | 805 | 765 | 819 | 10 | 20 | 43 |
| Example 28 | 1100 | 83 | 60 | 842 | 802 | 819 | 10 | 20 | 43 |
| Comparative Example 28 | 1100 | 83 | 60 | 833 | 793 | — | — | — | 43 |
| Example 29 | 1200 | 86 | 60 | 844 | 804 | 780 | 10 | 20 | 43 |
| Comparative Example 29 | 1200 | 86 | 60 | 832 | 792 | 780 | 10 | 20 | 43 |

TABLE 3-2-continued

| | Hot rolling | | | | | | | | |
|---|---|---|---|---|---|---|---|---|---|
| | Slab heating temperature ° C. | Total rolling reduction in hot rolling % | CR ratio % | CR start temperature ° C. | Temperature before one finishing pass ° C. | Water cooling start temperature ° C. | Average water cooling rate ° C./s | Water cooling finishing temperature ° C. | Plate thickness mm |
| Example 30 | 1060 | 86 | 60 | 817 | 777 | 779 | 10 | 150 | 43 |
| Comparative Example 30 | 1060 | 86 | 60 | 811 | 771 | 779 | 10 | 150 | 43 |
| Example 31 | 1050 | 90 | 67 | 834 | 794 | 720 | 50 | 20 | 18 |
| Comparative Example 31 | 1050 | 90 | 67 | 837 | 797 | 720 | 2.5 | 20 | 18 |
| Example 32 | 1050 | 90 | 67 | 816 | 745 | 710 | 50 | 20 | 18 |
| Comparative Example 32 | 1050 | 90 | 35 | 845 | 775 | 710 | 50 | 20 | 18 |
| Example 33 | 1050 | 90 | 67 | 810 | 740 | 720 | 50 | 20 | 18 |
| Comparative Example 33 | 1050 | 90 | 67 | 830 | 760 | 720 | 50 | 500 | 18 |

TABLE 4-1

| | Reheating quenching | | | Intermediate heat treatment | Tempering | |
|---|---|---|---|---|---|---|
| | Average temperature rising rate ° C./s | Heating temperature ° C. | Retention time min. | Heating temperature ° C. | Heating temperature ° C. | Retention time min. |
| Example 1 | 0.4 | 800 | 5 | — | 590 | 5 |
| Comparative Example 1 | 0.4 | 800 | 5 | — | 590 | 5 |
| Example 2 | 0.8 | 810 | 5 | — | 570 | 5 |
| Comparative Example 2 | 0.8 | 810 | 5 | — | 570 | 5 |
| Example 3 | 0.8 | 810 | 5 | — | 570 | 5 |
| Comparative Example 3 | 0.8 | 810 | 5 | — | 570 | 5 |
| Example 4 | 0.8 | 800 | 5 | 680 | 590 | 5 |
| Comparative Example 4 | 0.8 | 800 | 5 | 680 | 590 | 5 |
| Example 5 | 0.8 | 810 | 5 | — | 575 | 5 |
| Comparative Example 5 | 0.8 | 810 | 5 | — | 575 | 5 |
| Example 6 | 0.4 | 810 | 5 | — | 580 | 5 |
| Comparative Example 6 | 0.4 | 810 | 5 | — | 580 | 5 |
| Example 7 | 0.8 | 800 | 5 | — | 590 | 5 |
| Comparative Example 7 | 0.8 | 800 | 5 | — | 590 | 5 |
| Example 8 | 0.8 | 810 | 5 | — | 590 | 5 |
| Comparative Example 8 | 0.8 | 810 | 5 | — | 590 | 5 |
| Example 9 | 0.8 | 810 | 5 | 700 | 590 | 5 |
| Comparative Example 9 | 0.8 | 810 | 5 | 700 | 590 | 5 |
| Example 10 | 0.8 | 800 | 5 | — | 575 | 5 |
| Comparative Example 10 | 0.8 | 800 | 5 | — | 575 | 5 |
| Example 11 | 0.4 | 810 | 5 | — | 590 | 5 |
| Comparative Example 11 | 0.4 | 810 | 5 | — | 590 | 5 |
| Example 12 | 0.8 | 810 | 5 | — | 570 | 5 |
| Comparative Example 12 | 0.8 | 810 | 5 | — | 570 | 5 |
| Example 13 | 0.8 | 800 | 5 | 660 | 590 | 5 |
| Comparative Example 13 | 0.8 | 800 | 5 | 660 | 590 | 5 |
| Example 14 | 0.8 | 810 | 5 | — | 590 | 5 |
| Comparative Example 14 | 0.8 | 810 | 5 | — | 590 | 5 |
| Example 15 | 0.8 | 810 | 5 | — | 575 | 5 |
| Comparative Example 15 | 0.8 | 810 | 5 | — | 575 | 5 |

TABLE 4-1-continued

| | Reheating quenching | | | Intermediate heat treatment | Tempering | |
|---|---|---|---|---|---|---|
| | Average temperature rising rate ° C./s | Heating temperature ° C. | Retention time min. | Heating temperature ° C. | Heating temperature ° C. | Retention time min. |
| Example 16 | 0.4 | 800 | 20 | — | 580 | 20 |
| Comparative Example 16 | 0.4 | 800 | 20 | — | 580 | 20 |

TABLE 4-2

| | Reheating quenching | | | Intermediate heat treatment | Tempering | |
|---|---|---|---|---|---|---|
| | Average temperature rising rate ° C./s | Heating temperature ° C. | Retention time min. | Heating temperature ° C. | Heating temperature ° C. | Retention time min. |
| Example 17 | 0.8 | 810 | 20 | 670 | 570 | 20 |
| Comparative Example 17 | 0.1 | 810 | 20 | 670 | 570 | 20 |
| Example 18 | 0.8 | 810 | 20 | — | 570 | 20 |
| Comparative Example 18 | 0.2 | 810 | 20 | — | 570 | 20 |
| Example 19 | 0.8 | 810 | 20 | — | 590 | 20 |
| Comparative Example 19 | 0.8 | 860 | 20 | — | 590 | 20 |
| Example 20 | 0.8 | 810 | 20 | — | 590 | 20 |
| Comparative Example 20 | 0.8 | 810 | 20 | — | 590 | 20 |
| Example 21 | 0.4 | 800 | 20 | 690 | 580 | 20 |
| Comparative Example 21 | 0.1 | 800 | 20 | 690 | 690 | 20 |
| Example 22 | 0.8 | 810 | 20 | — | 570 | 20 |
| Comparative Example 22 | 0.1 | 810 | 20 | — | 480 | 20 |
| Example 23 | 0.8 | 810 | 20 | — | 590 | 20 |
| Comparative Example 23 | 0.8 | 810 | 20 | — | 590 | 20 |
| Example 24 | 0.8 | 800 | 20 | — | 590 | 20 |
| Comparative Example 24 | 0.1 | 800 | 20 | — | 590 | 20 |
| Example 25 | 0.8 | 810 | 20 | — | 575 | 20 |
| Comparative Example 25 | 0.8 | 810 | 20 | — | 575 | 20 |
| Example 26 | 0.4 | 810 | 20 | — | 590 | 20 |
| Comparative Example 26 | 0.4 | 810 | 20 | 660 | 590 | 20 |
| Example 27 | 0.8 | 800 | 20 | 660 | 570 | 20 |
| Comparative Example 27 | — | — | — | — | 570 | 20 |
| Example 28 | 0.8 | 810 | 20 | — | 590 | 20 |
| Comparative Example 28 | 0.8 | 810 | 20 | — | 590 | 20 |
| Example 29 | 0.8 | 810 | 20 | — | 590 | 20 |
| Comparative Example 29 | 0.8 | 810 | 20 | — | 590 | 20 |
| Example 30 | 0.8 | 810 | 20 | — | 575 | 20 |
| Comparative Example 30 | 0.8 | 810 | 20 | — | 575 | 20 |
| Example 31 | 0.8 | 810 | 5 | — | 580 | 5 |
| Comparative Example 31 | 0.8 | 810 | 5 | — | 580 | 5 |
| Example 32 | 0.8 | 810 | 5 | — | 570 | 5 |
| Comparative Example 32 | 0.8 | 810 | 5 | — | 565 | 5 |
| Example 33 | 0.8 | 810 | 5 | — | 585 | 5 |
| Comparative Example 33 | 0.8 | 810 | 5 | — | 585 | 5 |

TABLE 5-1

| | Average coarse grain size μm | Amount of retained γ volume % | Average aspect ratio — | Tensile strength MPa | Charpy impact absorbed energy at −196° C. J |
|---|---|---|---|---|---|
| Example 1 | 16 | 1.5 | 1.2 | 792 | 156 |
| Comparative Example 1 | 17 | 1.4 | 1.2 | 845 | 98 |
| Example 2 | 15 | 2.1 | 1.2 | 795 | 171 |
| Comparative Example 2 | 15 | 1.9 | 1.2 | 405 | 135 |
| Example 3 | 11 | 0.5 | 1.2 | 755 | 170 |
| Comparative Example 3 | 11 | 0.4 | 1.2 | 778 | 105 |
| Example 4 | 13 | 7.5 | 1.2 | 740 | 198 |
| Comparative Example 4 | 12 | 7.3 | 1.2 | 480 | 178 |
| Example 5 | 9 | 2.2 | 1.4 | 784 | 205 |
| Comparative Example 5 | 9 | 2.0 | 1.3 | 882 | 105 |
| Example 6 | 15 | 3.0 | 1.5 | 721 | 155 |
| Comparative Example 6 | 15 | 2.9 | 1.4 | 675 | 156 |
| Example 7 | 13 | 1.8 | 1.5 | 738 | 165 |
| Comparative Example 7 | 14 | 1.8 | 1.4 | 740 | 25 |
| Example 8 | 13 | 0.9 | 1.3 | 778 | 199 |
| Comparative Example 8 | 12 | 0.8 | 1.3 | 790 | 38 |
| Example 9 | 11 | 8.6 | 1.6 | 778 | 202 |
| Comparative Example 9 | 10 | 8.8 | 1.6 | 653 | 35 |
| Example 10 | 9 | 2.0 | 1.3 | 794 | 225 |
| Comparative Example 10 | 10 | 1.8 | 1.2 | 797 | 95 |
| Example 11 | 15 | 1.3 | 1.2 | 764 | 158 |
| Comparative Example 11 | 16 | 1.3 | 1.3 | 768 | 18 |
| Example 12 | 13 | 1.5 | 1.4 | 780 | 170 |
| Comparative Example 12 | 14 | 1.5 | 1.2 | 782 | 30 |
| Example 13 | 13 | 11.5 | 1.4 | 804 | 150 |
| Comparative Example 13 | 22 | 11.2 | 1.3 | 798 | 138 |
| Example 14 | 13 | 2.4 | 1.3 | 767 | 170 |
| Comparative Example 14 | 23 | 2.4 | 1.2 | 771 | 120 |
| Example 15 | 11 | 1.5 | 1.2 | 731 | 202 |
| Comparative Example 15 | 22 | 1.3 | 1.3 | 732 | 135 |
| Example 16 | 16 | 1.5 | 1.2 | 700 | 180 |
| Comparative Example 16 | 22 | 1.4 | 1.5 | 705 | 110 |

TABLE 5-2

| | Average coarse grain size μm | Amount of retained γ volume % | Average aspect ratio — | Tensile strength MPa | Charpy impact absorbed energy at −196° C. J |
|---|---|---|---|---|---|
| Example 17 | 14 | 6.8 | 1.4 | 718 | 168 |
| Comparative Example 17 | 25 | 6.6 | 1.2 | 720 | 115 |
| Example 18 | 11 | 1.8 | 1.3 | 704 | 170 |
| Comparative Example 18 | 22 | 1.7 | 1.3 | 708 | 122 |
| Example 19 | 11 | 1.6 | 1.2 | 703 | 177 |
| Comparative Example 19 | 21 | 1.5 | 1.3 | 705 | 140 |
| Example 20 | 8 | 0.9 | 1.2 | 753 | 270 |
| Comparative Example 20 | 9 | 0.8 | 1.3 | 757 | 25 |

TABLE 5-2-continued

| | Average coarse grain size μm | Amount of retained γ volume % | Average aspect ratio — | Tensile strength MPa | Charpy impact absorbed energy at −196° C. J |
|---|---|---|---|---|---|
| Example 21 | 15 | 7.6 | 1.7 | 694 | 190 |
| Comparative Example 21 | 22 | 18.3 | 1.8 | 697 | 78 |
| Example 22 | 13 | 0.3 | 1.3 | 755 | 158 |
| Comparative Example 22 | 23 | 0.1 | 1.4 | 759 | 55 |
| Example 23 | 13 | 1.0 | 1.4 | 776 | 170 |
| Comparative Example 23 | 22 | 0.9 | 1.4 | 771 | 130 |
| Example 24 | 12 | 0.8 | 1.3 | 726 | 175 |
| Comparative Example 24 | 23 | 0.8 | 1.2 | 741 | 135 |
| Example 25 | 16 | 2.1 | 1.2 | 798 | 175 |
| Comparative Example 25 | 21 | 2.0 | 1.3 | 802 | 140 |
| Example 26 | 16 | 1.4 | 1.5 | 754 | 160 |
| Comparative Example 26 | 16 | 5.6 | 1.4 | 739 | 97 |
| Example 27 | 18 | 5.8 | 1.2 | 712 | 152 |
| Comparative Example 27 | 19 | 1.8 | 2.2 | 716 | 45 |
| Example 28 | 18 | 2.5 | 1.4 | 766 | 155 |
| Comparative Example 28 | 17 | 2.4 | 1.2 | 759 | 72 |
| Example 29 | 16 | 0.9 | 1.4 | 737 | 168 |
| Comparative Example 29 | 15 | 0.9 | 1.5 | 741 | 18 |
| Example 30 | 8 | 1.8 | 1.4 | 738 | 220 |
| Comparative Example 30 | 8 | 1.7 | 1.3 | 743 | 38 |
| Example 31 | 12 | 1.9 | 1.3 | 742 | 180 |
| Comparative Example 31 | 22 | 1.7 | 1.3 | 745 | 27 |
| Example 32 | 12 | 2.2 | 1.4 | 745 | 172 |
| Comparative Example 32 | 21 | 2.1 | 1.2 | 742 | 32 |
| Example 33 | 14 | 2.9 | 1.2 | 740 | 202 |
| Comparative Example 33 | 22 | 2.8 | 1.5 | 745 | 55 |

As shown in Examples 1 to 33, the steel plate having the elements specified in the present invention and manufactured by the preferable manufacturing method had excellent tensile strength and toughness. From the above examples, it is clear that the steel plates of Examples 1 to 33 that are within the range of the present invention are steel plates having excellent tensile strength and toughness.

On the other hand, the comparative examples which did not satisfy the characteristics of the present invention were inferior in one or both of tensile strength and toughness.

In Comparative Example 1, an excessive amount of C caused a decrease in the toughness of the steel plate, so that the low temperature toughness was insufficient.

In Comparative Example 2, the amount of C, which is an essential element for securing the strength of the steel plate, was insufficient, so that a necessary tensile strength could not be achieved. In Comparative Example 2, the low temperature toughness was also impaired.

In Comparative Example 3, an excessive amount of Si caused a decrease in the toughness of the steel plate, so that the low temperature toughness was insufficient.

In Comparative Example 4, the amount of Si, which is an essential element for securing the strength of the steel plate, was insufficient, so that a necessary tensile strength could not be achieved.

In Comparative Example 5, an excessive amount of Mn was contained, so that the temper embrittlement parameter increased, and the toughness of the steel plate decreased.

In Comparative Example 6, the amount of Mn, which is an element effective in increasing the strength of the steel plate, was insufficient, so that a necessary tensile strength could not be achieved.

In Comparative Example 7, an excessive amount of P was contained, so that the toughness of the steel plate decreased due to temper embrittlement.

In Comparative Example 8 and Comparative Example 27, the amount of S was excessive, so that the toughness of the steel plate decreased.

In Comparative Example 9 and Comparative Example 30, Ni, which is essential for securing the toughness of the steel plate was insufficient, so that the toughness of the steel plate decreased. In Comparative Example 9, the tensile strength was also insufficient.

In Comparative Example 10, an excessive amount of Al was contained, so that the toughness of the steel plate decreased.

In Comparative Example 11 and Comparative Example 29, an excessive amount of N was contained, so that the toughness of the steel plate decreased.

In Comparative Example 12 and Comparative Example 28, an excessive amount of O was contained, so that the toughness of the steel plate decreased.

In Comparative Example 13, the austenite grain growth could not be suppressed, so that the average coarse grain size of the prior austenite at the ¼t position was too large and the toughness was impaired. It is presumed that this is because the steel piece heating temperature before hot rolling was high.

In Comparative Example 14 and Comparative Example 15, the austenite grain size during heating of reheating quenching became coarse, and as a result, the average coarse grain size of the prior austenite at the ¼t position became large, and the toughness was impaired. It is presumed that this is because the controlled rolling (CR) start temperature was high. Furthermore, in Comparative Example 15, the temperature before one finishing pass was high, which is considered to be the cause of an increase in the average coarse grain size of the prior austenite.

In Comparative Example 16 and Comparative Example 25, the austenite grain size during heating of reheating quenching became coarse, so that the average coarse grain size of the prior austenite at the ¼t position became large, and the toughness was impaired. It is presumed that this is because the total rolling reduction in hot rolling was low.

In Comparative Example 17, Comparative Example 18, and Comparative Example 24, the grain size of a coarse portion of the prior austenite at the ¼t position was too large, and the toughness was impaired. It is presumed that this is because the average temperature rising rate between 600° C. or higher and 750° C. or lower during the reheating quenching was low.

In Comparative Example 19, the prior austenite could not be refined and the toughness could not be improved. It is presumed that this is because the heating temperature during reheating quenching was high.

In Comparative Example 20, an excessive amount of P was contained, so that the toughness could not be improved.

In Comparative Example 21, the average coarse grain size of the prior austenite at the ¼t position was too large, so that the toughness was impaired. It is presumed that this is because the average temperature rising rate between 600° C. or higher and 750° C. or lower during reheating quenching was low and the heating temperature during tempering was high.

In Comparative Example 22, the average coarse grain size of the prior austenite at the ¼t position was too large, and temper embrittlement occurred, so that the low temperature toughness was impaired. It is presumed that this is because the average temperature rising rate between 600° C. or higher and 750° C. or lower during reheating quenching was low and the heating temperature during tempering was low.

In Comparative Example 23, the microstructure when cooled to room temperature by water cooling could not be refined, and the average coarse grain size of the prior austenite increased, so that the low temperature toughness was impaired. It is presumed that this is because the temperature before one finishing pass was high.

In Comparative Example 26, an excessive amount of P and S was contained, so that the toughness of the steel plate decreased due to temper embrittlement or the like.

In Comparative Example 31, the austenite grain size during heating of reheating quenching became coarse, so that the average coarse grain size of the prior austenite at the ¼t position became large, and the low temperature toughness was impaired. It is presumed that this is because the average water cooling rate at the time of direct quenching after hot rolling was insufficient.

In Comparative Example 32, the austenite grain size during heating of reheating quenching became coarse, so that the average coarse grain size of the prior austenite at the ¼t position could not be refined, and a decrease in the toughness was caused. It is presumed that this is because the total rolling reduction in controlled rolling was insufficient and the heating temperature during tempering was insufficient.

In Comparative Example 33, the microstructure could not be refined, and the average coarse grain size of the prior austenite at the ¼t position increased, so that a decrease in toughness was caused. It is presumed that this is because the water cooling finishing temperature at the time of direct quenching after hot rolling was too high.

FIG. 1 shows a graph in which the horizontal axis represents the average coarse grain size of prior austenite and the vertical axis represents the low temperature toughness. In the graph of FIG. 1, among Examples 1 to 33 and Comparative Examples 1 to 33 described above, those whose chemical compositions were within the ranges of the invention were plotted. According to the graph of FIG. 1, it can be seen that the Charpy absorbed energy at −196° C. of the examples in which the average coarse grain size of the prior austenite was 20 μm or less became 150 J or more, and the Charpy absorbed energy at −196° C. tends to increase as the average coarse grain size decreases.

Figure 2:
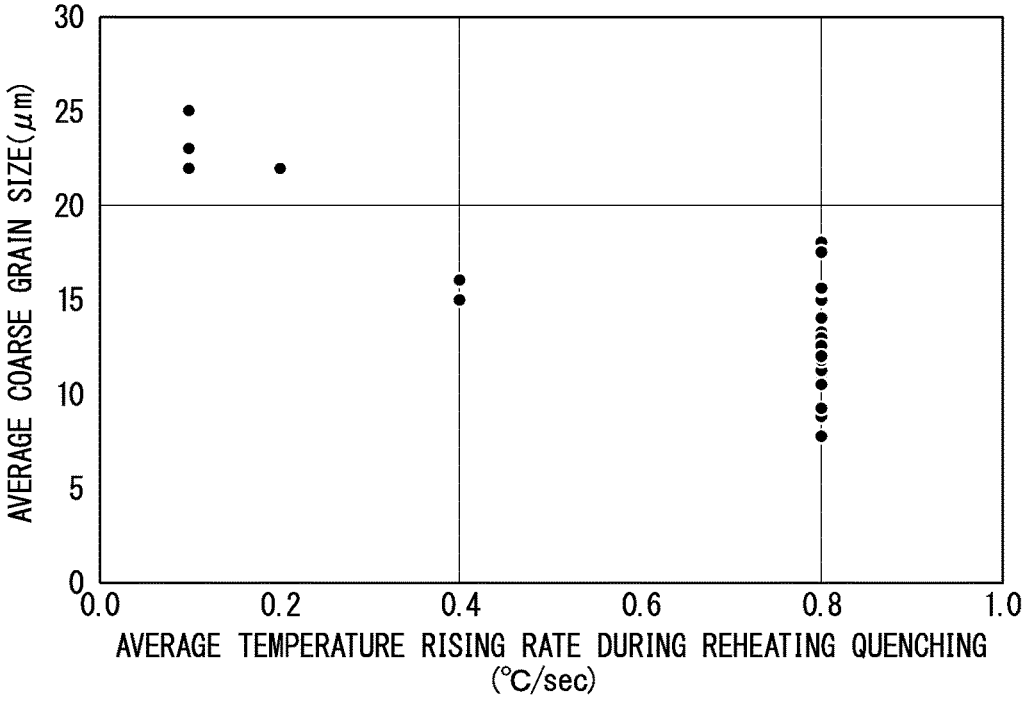
FIG. 2 is a graph showing the relationship between an average temperature rising rate in a temperature range of 600° C. or higher and 750° C. or lower and the average coarse grain size of prior austenite of the nickel-containing steel plate during reheating quenching.

FIG. 2 shows a graph in which the horizontal axis represents the average temperature rising rate in a temperature range of 600° C. or higher and 750° C. or lower during reheating quenching, and the vertical axis represents the average coarse grain size of the prior austenite. In the graph of FIG. 2, among Examples 1 to 33 and Comparative Examples 1 to 33 described above, those in which chemical compositions were within the ranges of the invention and the manufacturing conditions other than the average temperature rising rate during reheating quenching were preferably controlled were plotted. According to the graph of FIG. 2, it can be seen that in the examples in which the average temperature rising rate was 0.4° C./sec or more and 0.8° C. or less, the average coarse grain size of the prior austenite was controlled to 20 μm or less.

INDUSTRIAL APPLICABILITY

The steel plate according to the present invention has excellent low temperature toughness and thus can be used for general welded structures such as shipbuilding, bridges, architecture, offshore structures, pressure vessels, tanks, and line pipes, thereby providing high industrial applicability. In particular, the present invention has very high industrial applicability in use in a low temperature tank that requires fracture toughness at a low temperature of about −196° C.

The invention claimed is:

1. A nickel-containing steel plate comprising, as a chemical composition, by mass %:

C: 0.02% to 0.12%;
Si: 0.02% to 0.35%;
Mn: 0.10% to 1.50%;
P: 0.0100% or less;
S: 0.0035% or less;
Ni: more than 5.0% and 10.0% or less;
Al: 0.002% to 0.090%;
N: 0.0070% or less;
O: 0.0030% or less;
Cu: 0% to 2.00%;
Cr: 0% to 5.00%;
Mo: 0% to 1.00%;
B: 0% to 0.0050%;
Nb: 0% to 0.050%;
Ti: 0% to 0.050%;
V: 0% to 0.050%;
Ca: 0% to 0.0300%;
Mg: 0% to 0.0300%;
REM: 0% to 0.0300%; and
a remainder: Fe and impurities, wherein an average coarse grain size of prior austenite which is defined as a simple average value of maximum values of equivalent circle diameters of prior austenite grains in each of ten visual fields having an area of 200 $\mu m^2$, measured at a ¼t position of the steel plate in a section formed by a rolling direction of the steel plate and a thickness direction of the steel plate, is 20 μm or less, and a tensile strength is 690 MPa to 900 MPa.

2. The nickel-containing steel plate according to claim 1, wherein an average aspect ratio of the prior austenite grains defined as a simple average value of ratios between major axes and minor axes of the prior austenite grains in the visual fields of 200 $\mu m^2$ in the section at the ¼t position is 1.5 or less.

3. The nickel-containing steel plate according to claim 1, wherein an amount of residual austenite at the ¼t position is 0.1% or more and less than 5% by volume %.

4. The nickel-containing steel plate according to claim 1, wherein an amount of residual austenite at the ¼t position is 5% to 15% by volume %.

5. The nickel-containing steel plate according to claim 2, wherein an amount of residual austenite at the ¼t position is 0.1% or more and less than 5% by volume %.

6. The nickel-containing steel plate according to claim 2, wherein an amount of residual austenite at the ¼t position is 5% to 15% by volume %.

* * * * *